United States Patent [19]

Douthett et al.

[11] 4,261,739

[45] Apr. 14, 1981

[54] FERRITIC STEEL ALLOY WITH IMPROVED HIGH TEMPERATURE PROPERTIES

[75] Inventors: Joseph A. Douthett, Monroe; Ronald H. Espy, West Chester, both of Ohio; D. Cameron Perry

[73] Assignee: Armco Inc., Middletown, Ohio

[21] Appl. No.: 63,676

[22] Filed: Aug. 6, 1979

[51] Int. Cl.[3] ..... C22C 38/06; C22C 38/26; C22C 38/28

[52] U.S. Cl. ..... 75/124; 148/12 EA; 148/36; 148/37

[58] Field of Search ..... 75/126 D, 126 F, 126 J, 75/126 Q, 128 C, 128 G, 128 R, 128 T, 124; 148/36, 39, 12 EA, 37

[56] References Cited

U.S. PATENT DOCUMENTS

| | | | |
|---|---|---|---|
| 2,673,166 | 3/1954 | Carruthers | 148/12 |
| 2,848,323 | 8/1958 | Harris et al. | 75/124 |
| 2,905,577 | 9/1959 | Harris et al. | 148/31 |
| 3,694,192 | 9/1972 | Brickner | 75/126 B |
| 3,759,705 | 9/1973 | Chalk | 75/124 |
| 3,778,316 | 12/1973 | Dinnow et al. | 148/12 |
| 3,890,143 | 6/1975 | Skoglund et al. | 75/125 |
| 3,909,250 | 9/1975 | Jasper | 75/124 |
| 3,953,201 | 4/1976 | Wood et al. | 75/126 C |
| 4,054,448 | 10/1977 | Wright | 75/126 B |
| 4,059,440 | 11/1977 | Takemura | 75/126 C |
| 4,078,919 | 3/1978 | Kado et al. | 75/124 |
| 4,140,526 | 2/1979 | Moroishi et al. | 75/126 F |
| 4,141,724 | 2/1979 | Brickner et al. | 75/126 D |

FOREIGN PATENT DOCUMENTS

| | | | |
|---|---|---|---|
| 40-28325 | 12/1965 | Japan | 148/12 |
| 1262588 | 2/1972 | United Kingdom . | |

OTHER PUBLICATIONS

Espy et al., Armco Rept. #1, 2/1972, pp. 1-21.
Oldrieve et al., NASA-TN-D7966, Jun. 1975.
Onoyama et al., Nippon Steel Tech. Report #12, Dec. 1978, pp. 29-38.
D. C. Perry, Memorandom with Distribution List, Nov. 1977.

*Primary Examiner*—L. Dewayne Rutledge
*Assistant Examiner*—Upendra Roy
*Attorney, Agent, or Firm*—Frost & Jacobs

[57] ABSTRACT

A ferritic steel having improved creep or sag resistance and oxidation resistance at temperatures ranging from about 732° to 1093° C. after a final anneal at 1010° to 1120° C., together with good weldability, the steel consisting essentially of, by weight percent, from about 0.01% to 0.06% carbon, about 1% maximum manganese, about 2% maximum silicon, about 1% to about 20% chromium, about 0.5% maximum nickel, about 0.5% to 2% aluminum, about 0.1% to 0.05% nitrogen, 1.0% maximum titanium, with a minimum titanium content of 4 times the percent carbon plus 3.5 times the percent nitrogen, about 0.1% to 1.0% columbium, with the sum total of titanium plus columbium not exceeding about 1.2%, and remainder essentially iron. In the form of cold reduced strip and sheet stock the steel has particular utility in motor vehicle components.

13 Claims, 3 Drawing Figures

FERRITIC STEEL ALLOY WITH IMPROVED HIGH TEMPERATURE PROPERTIES

BRIEF SUMMARY OF THE INVENTION

This invention relates to ferritic steel alloys containing up to 20% by weight chromium which in annealed condition exhibit improved oxidation resistance and creep (or sag) resistance at elevated temperature together with good weldability by fillerless fusion welding techniques. Although not so limited, steels of the present invention have particular utility in motor vehicle components such as exhaust systems, emission control systems, and the like.

Recent emphasis on emission control and fuel conservation has led to a demand for steels having good high temperature strength and resistance against oxidation and corrosion which at the same time minimize weight. It will of course be recognized that an increase in strength permits a saving in weight by designing a component of lower gauge or thickness.

Ferritic steels have inherent advantages for applications requiring oxidation resistance at elevated temperature, in comparison to austenitic steels. These advantages include:

lower coefficient of thermal expansion, thus facilitating joining to other steel or cast iron parts;

higher thermal conductivity;

better oxidation resistance, particularly under cyclic conditions;

lower cost.

On the other hand, ferritic steels have the following disadvantages when compared to austenitic counterparts:

inferior strength at elevated temperature;

potential welding problems;

less formability.

In considering the inferior strength at elevated temperature of a ferritic steel, designers are principally concerned with creep or sag resistance. Allowances can be made, in designing, to avoid high strain rate failures such as those measured by elevated temperature short time tensile and stress rupture tests. Creep and sag strength are the most difficult design problems. Due to the low strain rate testing, creep strength represents the lowest strength property faced by a designer. Consequently, if the creep or sag strength of a ferritic steel can be significantly improved, even without improvement in other properties, a wide variety of applications become available in which such ferritic steels may replace austenitic steels or cast iron.

It is therefore a principal object of the present invention to provide a ferritic steel exhibiting improved creep strength at elevated temperature, and good weldability, while retaining good oxidation and corrosion resistance.

A number of ferritic, chromium-containing steels with an aluminum addition have been developed which exhibit improved oxidation resistance at elevated temperature. The aluminum addition also tends to lower the amount of chromium needed. Such steels may also contain titanium or columbium.

A nominal 2% chromium, 2% aluminum, 1% silicon and 0.5% titanium steel is disclosed in U.S. Pat. No. 3,909,250, issued Sept. 30, 1975. In this patent the titanium content preferably is at least ten times the carbon content, the excess titanium over that needed to stabilize carbon being relied upon for improved oxidation resistance. Columbium and zirconium are mentioned as possible substitutes for titanium. Molybdenum, vanadium and copper are maintained at low levels since these elements act as austenite stabilizers. U.S. Pat. No. 3,759,705 discloses a nominal 18% chromium, 2% aluminum, 1% silicon and 0.5% titanium ferritic stainless steel. Titanium is usually added in an amount at least four times the carbon plus nitrogen contents or six times the carbon content if nitrogen values are not available during production. Titanium may be present up to fifteen to twenty times the carbon content, but the excess is stated to tend toward undesirable hardness, stiffness and decreased formability. The use of columbium to stabilize carbon and nitrogen is also suggested, as is a combination of titanium and columbium. The preference is for the use of titanium by itself on the basis of lower cost, and for best scaling resistance the titanium addition is equal to or greater than six times the carbon content.

U.S. Pat. No. 3,782,925, issued Jan. 1, 1974, discloses a ferritic stainless steel containing 10% to 15% chromium, 1% to 3.5% aluminum, 0.8% to 3.0% silicon, 0.3% to 1.5% titanium and up to 1.0% columbium plus tantalum or zirconium. This patent calls for a titanium addition of at least 0.2% above that needed for stabilization of carbon. The optional presence of columbium may prevent grain coarsening during welding which produces brittleness. Calcium or cerium are also purposefully added for scale adherence.

British Pat. No. 1,262,588 (published May 22, 1969) discloses a ferritic stainless steel containing 11% to 12.5% chromium, 0.5% to 10% aluminum, up to 3.0% silicon, and at least one of titanium, columbium, zirconium, or tantalum. This patent indicates that a "positive" titanium equivalency must be observed, with an excess of titanium (above that needed for stabilization) up to 0.45%. Excess columbium, zirconium or tantalum, if present, could also be above the level needed to combine with carbon and nitrogen. Improved oxidation resistance is alleged to result when aluminum is from 2% to 3.5%. An increase in oxidation resistance is stated to result when the titanium equivalency is high. Data relating to columbium additions are set forth in Table VIII, and these all relate to substantial excesses of titanium equivalents with low aluminum contents. The patent concludes by indicating that at 0.3% aluminum, columbium is not effective as a carbide and nitride former for providing high temperature oxidation resistance. At 0.6% aluminum, columbium is effective, but no mention is made of the effect of the other elements with low aluminum content.

While all the alloys representative of the above patents would exhibit superior oxidation resistance at elevated temperatures, these would nevertheless exhibit the disadvantages typical of ferritic steels including poor creep or sag strength at elevated temperature, and potential problems in welding.

NASA TN-D7966, published June 1975 and entitled "Modified Ferritic Iron Alloys With Improved High-Temperature Mechanical Properties And Oxidation Resistance", discloses alloy modifications in nominal 15% and 18% chromium ferritic steels and evaluations of the properties thereof. It was concluded that addition of 0.45% to 1.25% tantalum to a nominal 18% chromium, 2% aluminum, 1% silicon and 0.5% titanium alloy provided the greatest improvement in fabricability, tensile strength and stress-to-rupture strength at 1800° F. (1000° C.), together with oxidation resistance and corrosion resistance at elevated temperature. No modifications of the nominal 15% chromium alloy were successful in achieving better fabricability without sacrificing elevated temperature strength and oxidation resistance. In the processing of these alloys a final anneal at about 1000° C. was conducted after cold rolling to about 1.6 mm thickness. Some samples were further cold reduced to 0.5 mm thickness and subjected to varying annealing temperatures ranging from 926° to 1065° C.

In NASA TN D-7966, alloying modifications included addition of tantalum (from 0.45% to 1.25%) to the nominal 18% chromium, 2% aluminum, 1% silicon and 0.5% titanium steel disclosed in the above-mentioned U.S. Pat. No. 3,759,705, sold by Armco Inc. under the trademark "Armco 18SR". A further modification involved addition of molybdenum (2.08%) and columbium (0.58%) to a nominal 18% chromium, 2% aluminum, and 1% silicon steel which contained no titanium.

Nippon Steel Technical Report No. 12, published December 1978, pages 29–38, discloses ferritic steels containing from 16% to 25% chromium, 0.75% to 5% molybdenum, titanium and columbium equal to or greater than 8 times the carbon plus nitrogen contents. It was concluded therein that resistance to intergranular corrosion and pitting corrosion result from a reduction in the carbon plus nitrogen content as interstitital elements. Addition of titanium and columbium was for the purpose of stabilizing carbon and nitrogen. It was theorized that titanium contributes to increased tensile strength but decreased ductility.

In Nippon Steel Technical Report No. 12, intergranular corrosion resistance was tested by heat treating samples at temperatures ranging from 900° to 1300° C. (for 5 minutes followed by various cooling rates) in order to simulate sensitization which might occur during welding. It was found that susceptibility to intergranular corrosion was not avoided by reduction of carbon and nitrogen to very low levels, but it was avoided by addition of titanium and/or columbium in an amount equal to or greater than 16 times the combined carbon plus nitrogen contents when carbon plus nitrogen exceeded 0.017%. The alloys so tested were nominal 17% chromium, 1% molybdenum steels containing no aluminum and substantially no silicon.

U.S. Pat. No. 4,155,752, issued May 22, 1979 to R. Oppenheim et al, discloses a ferritic chromium-molybdenum-nickel steel containing columbium (niobium), zirconium and aluminum, and optionally containing up to 0.25% titanium.

The steel of this patent is stated to exhibit high resistance against general and intercrystaline corrosion attack as well as against pitting, crevice and stress corrosion in chloride-containing media.

Although the broad range for aluminum in this patent is 0.01% to 0.25% by weight, it is stated at column 5, lines 28–31 that a maximum content of 0.10% aluminum is "the upper permissible alloying limit for an aluminum addition." This limitation is attributed to the partial solubility of aluminum nitride in the heat affected zone of a weld which can lead to precipitation of chromium nitrides on the grain boundaries if cooled rapidly.

Titanium is an optional ingredient which may be added "to supplement or partially replace the aluminum content for binding the nitrogen by adding twice the amount of titanium therefor" with high carbon plus nitrogen contents.

In this patent the columbium content is at least 12 times the carbon content although a maximum of 0.60% columbium must be observed in order to obtain bendability and elongation of welded joints. This apparently is the basis for establishing the maximum carbon content at 0.05%. In addition to the limitation on the maximum columbium content, it is further stated that columbium plus zirconium must be less than 0.80%, although the broad upper limit for zirconium is 0.5%. The criticality of the columbium plus zirconium contents of less than 0.80% is not supported by any data in this patent.

Nitrogen ranges from 0.02% to 0.08%, and free nitrogen which has not been bound by columbium and aluminum is bound by zirconium. It is stated that the zirconium addition is "not for binding carbon but is matched exclusively to the nitrogen content . . . " (column 4, lines 35–37).

In accordance with the present invention there is provided a ferritic steel having improved creep resistance and oxidation resistance at temperatures ranging from about 732° to 1093° C. together with good weldability, after being subjected to a final anneal at 1010° to 1120° C., the steel consisting essentially of, by weight percent, from about 0.01% to 0.06% carbon, about 1% maximum manganese, about 2% maximum silicon, about 1% to about 20% chromium, about 0.5% maximum nickel, about 0.5% to about 2% aluminum, about 0.01% to 0.05% nitrogen, 1.0% maximum titanium, with a minimum titanium content of 4 times the percent carbon plus 3.5 times the percent nitrogen, about 0.1% to 1.0% columbium, with the sum total of titanium plus columbium not exceeding about 1.2%, and remainder essentially iron.

DETAILED DESCRIPTION

Figure 1:
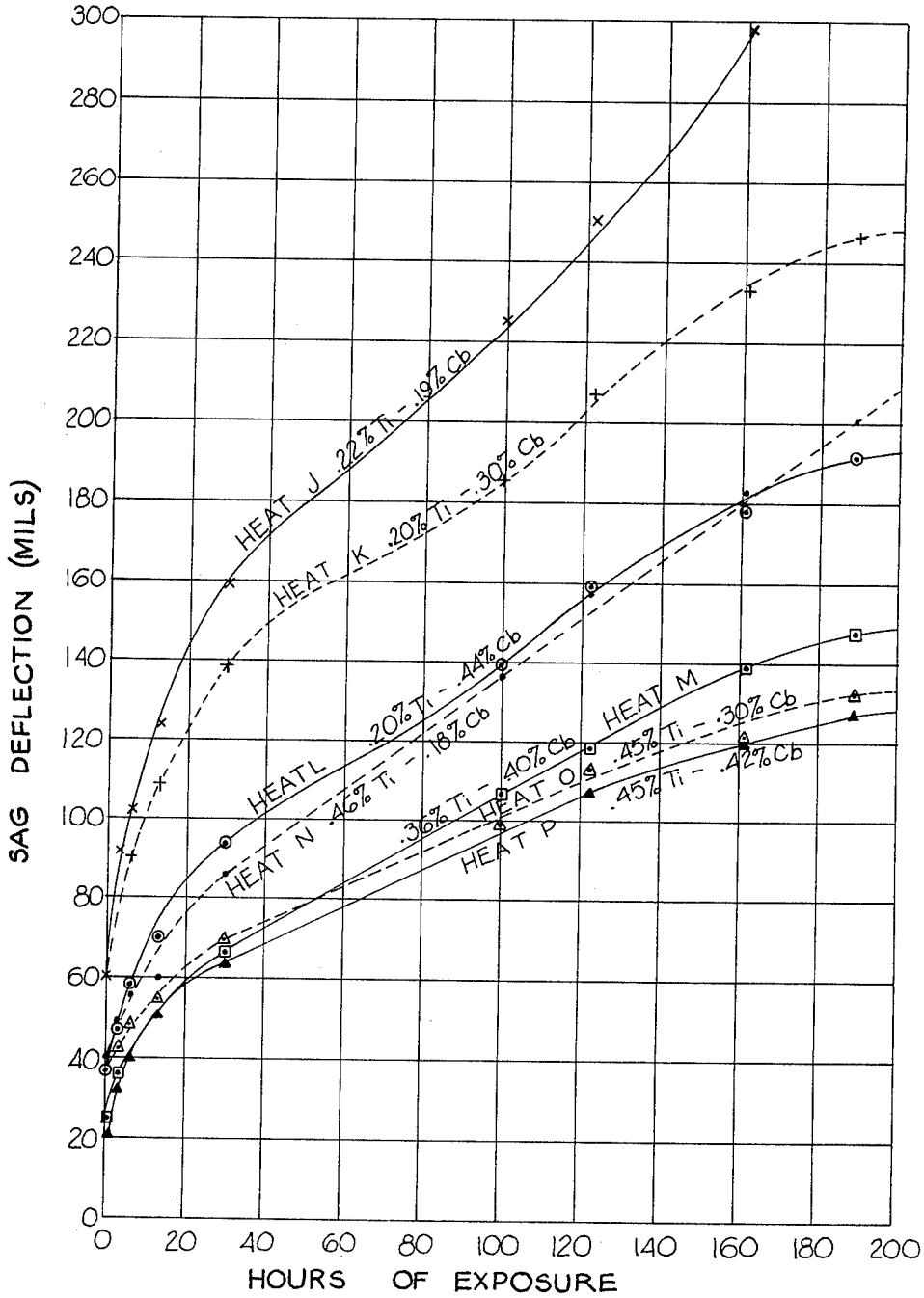
FIG. 1 is a graphic representation of creep or sag resistance of steels embodying the invention plotted as sag deflection vs. hours of exposure.

It has been discovered that marked improvement in creep or sag strength at elevated temperature can be achieved in ferritic steels throughout a chromium range of about 1% to about 20% by weight, with good elevated temperature oxidation resistance, and good weldability by fillerless fusion welding, by addition of columbium and titanium to an iron-aluminum-silicon base alloy in which the carbon and nitrogen contents are controlled within critical limits. Both titanium and columbium must be present for optimum properties. Superior creep or sag resistance at elevated temperature has been found to result from addition of titanium and columbium in sum total close to 1.0% and subjecting the steel to a final anneal at 1010° to 1120° C.

Conventional final annealing temperatures for ferritic steels range from about 760° to about 925° C. The higher final annealing temperature range of the present invention, i.e. from 1010° to 1120° C., when applied to the titanium and columbium containing steel of the present invention, contributes significantly to improved elevated temperature creep strength. Although not intending to be bound by theory, the high temperature range for final heat treatment is believed to contribute to improved creep resistance in the following ways:

(1) The anneal at 1010° to 1120° C. increases the final grain sizes. Larger grain sizes increase creep strength.

(2) The presence of titanium and columbium result in carbide and nitride precipitates (particularly of the titanium variety). As the grains increase in size, the precipitates act to pin the grain boundaries, thus retarding the creep mechanism.

(3) The soluble columbium level, and to some extent the soluble titanium level, act to strengthen the ferritic matrix by solid solution formation.

Optimum properties are obtained in a preferred composition of the invention consisting essentially of, by weight percent, from about 0.01% to about 0.03% carbon, about 0.5% maximum manganese, about 1% maximum silicon, about 1% to about 19% chromium, about 0.3% maximum nickel, about 0.75% to 1.8% aluminum, about 0.01% to about 0.03% nitrogen, about 0.5% maximum titanium, about 0.2% to about 0.5% columbium, and remainder essentially iron. As in the broad composition, the preferred minimum titanium content is 4 times the percent carbon plus 3.5 times the percent nitrogen. Preferably the sum total of titanium plus columbium is from 0.6% to 0.9%.

The broad maximum carbon content of 0.06% and broad nitrogen maximum content of 0.05% are critical in every respect. These relatively low carbon and nitrogen maximum values minimize the amount of titanium and columbium needed to stabilize the steel and hence keep the cost of alloying elements at a minimum.

Chromium contents between about 1% and about 20% are utilized to select the desired oxidation resistance at minimum cost. Thus, a nominal 2% chromium alloy will survive cyclic oxidation up to about 732°-760° C. A nominal 4% to 7% chromium alloy would survive cyclic oxidation up through about 815%° C. A nominal 11% to 13% chromium alloy would survive cyclic oxidation at about 925° to 955° C., while an 18% to 20% chromium alloy would withstand exposures up to about 1093° C.

A minimum aluminum content of 0.5% and preferably 0.75% is needed to provide oxidation resistance at elevated temperature. A maximum of 2% aluminum should be observed to minimize the detrimental effect of aluminum on weldability.

Silicon can be relied upon to supplement oxidation resistance, and a broad maximum of 2% is thus specified for this purpose. A preferred maximum of 1% is usually sufficient, and if optimum oxidation resistance is not required, silicon may range down to a typical residual level as low as about 0.4%.

A maximum of 1% manganese and 0.5% nickel should be observed, and both elements should be restricted to the lowest practicable levels since they promote and/or stabilize austenite which adversely affects the oxidation resistance of ferritic steels.

Titanium is restricted to a broad maximum of 1.0%, and preferably to a maximum of 0.5%. Titanium refines weld microstructures and aids formability. The titanium content is preferably balanced with the carbon and nitrogen contents so as to provide just enough for stabilization, thereby improving creep strength at elevated temperature and weldability.

A broad maximum of 1.0% columbium must be observed, with the further proviso that the sum total of titanium plus columbium does not exceed about 1.2%. A preferred columbium range of about 0.2% to about 0.5%, most of which will be present in solid solution in the final product, is effective to confer markedly improved creep strength at elevated temperature, after a high final anneal at 1010° C. When both titanium and columbium are present, titanium preferentially combines with nitrogen and carbon, and these titanium carbides and nitrides contribute to improved creep strength, as explained above. Hence, if the titanium content is balanced to be about 4 times the percent carbon plus 3.5 times the percent nitrogen, very little if any columbium is needed to stabilize carbon and nitrogen. The presence of columbium without titanium has been found to be detrimental to weldability since it produces a coarse dendritic weld structure with poor formability. Accordingly, the simultaneous addition of both elements is essential to obtain both improved creep strength and weldability.

Normal residual amounts of sulfur and phosphorus can be tolerated as incidental impurities.

Two heats were prepared, which were not in accordance with the steel of the present invention due to absence of aluminum, and these were subjected to processing and heat treatment which demonstrate the superior creep strength resulting from a final anneal within the range of 1010° to 1120° C. The compositions of these two heats A and B are set forth in Table I, and sag resistance tests at 871° and 899° C. under varying annealing conditions are summarized in Tables II and III, respectively.

Heats A and B were air melted and processed by hot rolling from a temperature of 1120° C. to a thickness of 2.54 mm, annealed at 1065° C. for 10 minutes, descaled by shot peening and pickling in nitric and hydrofluoric acids, and cold rolled with a 50% reduction in thickness to 1.27 mm strip. Some samples were annealed at 871° C. for 6 minutes, others at 1038° C. for 6 minutes, while the remainder were annealed at 871° and 1038° C. for 6 minutes at each temperature. Finally the annealed strip samples were descaled in nitric and hydrofluoric acids.

It is evident from Tables II and III that the creep or sag resistance of the samples subjected to the high final annealing temperatures was far superior to the samples annealed at 871° C.

A series of nominal 12% chromium alloys was prepared and tested, two of which were in accordance with the invention. For purposes of comparison the remaining heats of the series were prepared with variations in soluble columbium levels and with and without titanium additions. The compositions of this series of heats C-G are set forth in Table IV. The processing of cold rolled strips to 1.27 mm thickness was the same as that set forth above for heats A and B, except that a hot rolling temperature of 1150° C. was used, and the cold rolled strip was subjected to a single final anneal at 1065° C. for 6 minutes.

Mechanical properties of the annealed, cold rolled strip are set forth in Table V. It is evident that similar strength and ductilities were obtained at all levels of titanium and columbium with a slight tendency toward higher strengths at higher columbium contents. It is significant to note that heats F and G in accordance with the invention exhibited formability (as measured by the Olsen Cup test) superior to that of heat C which contained no titanium and no columbium in solid solution.

Elevated temperature sag tests are summarized in Table VI and show the proportionality of sag strength to the soluble columbium content and to the columbium plus titanium contents. Heat C, containing no titanium and no soluble columbium, performed very poorly. A comparison of heats D and E, containing no titanium, with heats F and G, containing titanium and soluble columbium, illustrates a synergistic effect from the presence of both titanium and soluble columbium with respect to elevated temperature creep or sag strength.

Autogenous G.T.A. welded properties of heats C–G are summarized in Table VII. It is evident that the addition of titanium in heats F and G improved weldability as compared to heats D and E containing soluble columbium and no titanium. Heat C had weldability comparable to that of heats F and G since no soluble columbium was present therein. It is therefore evident that titanium is essential for good weld properties.

A number of samples of heat G were subjected to final annealing after cold rolling at varying temperatures, rather than the single final anneal at 1065° C. for six minutes, to which the other samples of heats C–G were subjected. Metallographic examination of the samples subjected to varying final annealing temperatures were performed. Grain size ratings were as follows:

| Annealing Temp. °C. | ASTM Grain Size Rating |
|---|---|
| 871 | 8 elongated 4/1 |
| 927 | 8 elongated 4/1 |
| 982 | 8 elongated 2/1 |
| 1038 | 6 equiaxed |
| 1093 | 5/6 equiaxed |
| 1149 | 5 equiaxed |

It is evident that an increase in annealing temperature from 982° C. to 1038° C. and higher resulted in an equiaxed grain two sizes larger than those annealed at 982° C. and lower. These larger equiaxed grain sizes are known to aid creep strength. When annealed at 1038° C. or above, it appeared that the existing precipitates (principally titanium carbides and nitrides) segregated in grain boundary areas, thereby pinning such boundaries against grain sliding, which is the predominant mechanism in metallic creep. Such findings confirm the hypothesis set forth above of two of the possible mechanisms of strengthening, namely increased grain size and grain boundary pinning due to precipitates. The hypothesis of solid solution strengthening with columbium is also confirmed by comparison of the sag test results in Table VI of heat C with heats D–G.

Another series of nominal 12% chromium heats was prepared with varying titanium, columbium and aluminum levels, and these heats were processed in the same manner as heats C–F except for a hot rolling temperature of 1260° C. In all these heats sufficient titanium was added to fully stabilize the melts. One of the purposes of this series of heats was to determine whether better G.T.A. weldability could be obtained by lowering the aluminum content while adding titanium. The compositions of heats I–P are set forth in Table VIII, and the mechanical properties of cold rolled strip after final annealing at 1065° C. are set forth in Table IX. Autogenous G.T.A. welded properties of the same heats are summarized in Table X. A comparison of the 1.7% aluminum-containing heats C–G with the 0.77% to 1.37% aluminum-containing heats I–P indicates that the alloys having the lower aluminum content exhibited significantly more formability and ductility in the as-welded condition. The tensile tests of the as-welded material were comparable to those of the unwelded base metal. Such weld ductility is at least comparable to that of Type 409, which is considered the standard for 12% chromium ferritic steels.

Figure 2:
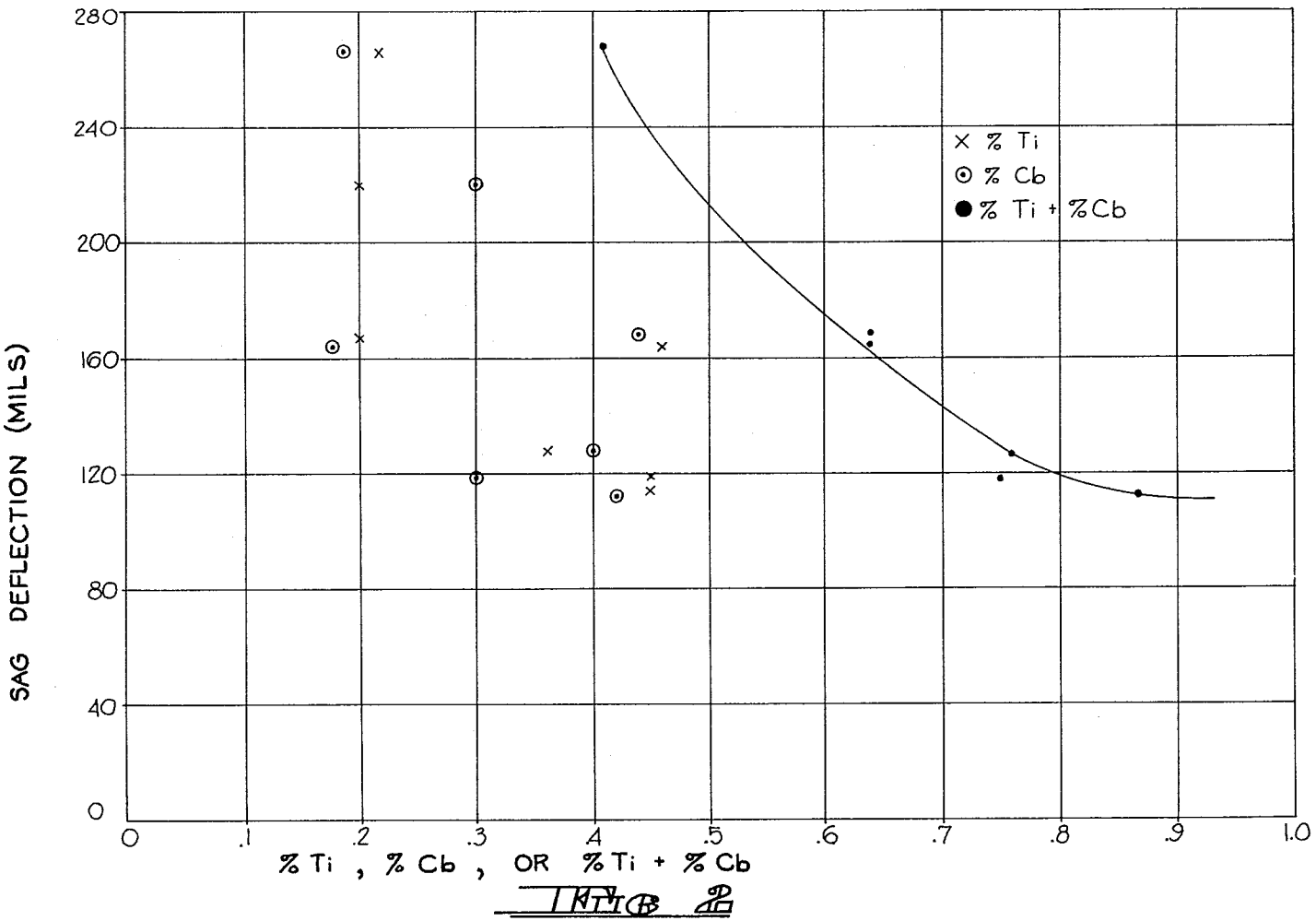
FIG. 2 is a graphic representation of creep resistance of the steels of FIG. 1 plotted as sag deflection vs. titanium content, columbium content, and combined titanium plus columbium contents, respectively.

Sag tests on heats J–P at 871° C. are illustraded graphically in FIG. 1. The values plotted in FIG. 1 clearly indicate that sag resistance increases in direct proportion to the total titanium plus columbium contents. In order to show the interrelation between the sum total of titanium plus columbium as compared to total titanium or total columbium alone, FIG. 2 is a graphic plot of sag deflection after 140 hours of testing against tittanium level, columbium level, and titanium plus columbium level. It will be noted that there is considerable scatter among the data points when either titanium or columbium is plotted alone. On the other hand the plot of sum total titanium plus columbium against deflection after 140 hours provides a relatively smooth slope which further indicates that the elevated temperature strengthening effect of titanium plus columbium starts to level out at about 0.85% titanium plus columbium. Accordingly, sum total additions of titanium plus columbium in excess of 1.2% could not be expected to provide further increase in creep strength at elevated temperature.

Figure 3:
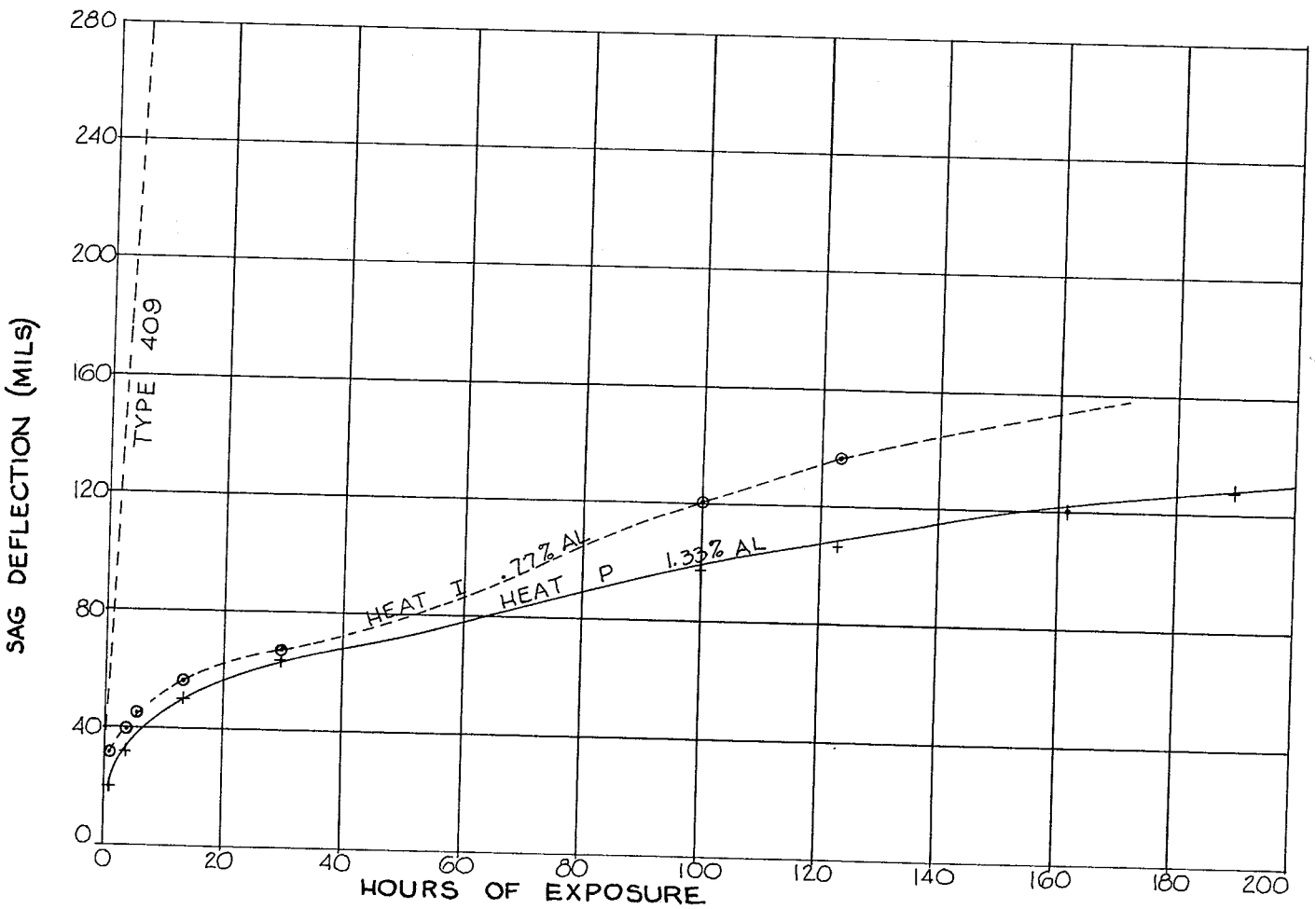
FIG. 3 is a graphic representation of the effect of aluminum content of representative steels on creep resistance plotted as sag deflection vs. hours of exposure.

FIG. 3 is a graphic illustration of the effect of variation in aluminum content on creep strength, utilizing test results on heats I and P. It is evident that variations in aluminum content between 0.77% and 1.33% have no marked effect on sag resistance. Accordingly, maintenance of the aluminum content to a value low enough to improve weldability would not significantly detract from the creep or sag strength of the steels of the present invention. Sag test of FIGS. 2 and 3 were conducted at 871° C.

On the other hand, the known beneficial effect of aluminum on oxidation resistance is shown by test results in Table XI. In comparison to type 409, it is clear that all the steels of this invention are far superior in the cyclic oxidation resistance tests.

For an optimum balance of oxidation resistance and weldability, the aluminum content should preferably be maintained between about 1.0% and 1.5%.

Additional heats were prepared to demonstrate the applicability of the titanium plus columbium addition coupled with a final high temperature anneal at the extremes of the chromium range with respect to increase in creep or sag strength. Compositions of heats Q–S are set forth in Table XI, while sag tests on these heats are summarized in Table XIII and XIV. Table XIII indicates that for a nominal 18% chromium alloy annealing at 1093° C. greatly improves sag strength as compared to annealing at 927° C., and that the addition of columbium within the ranges specified herein also greatly improves sag strength. Table XIV shows that a nominal 2% chromium alloy is similarly strengthened by addition of titanium plus columbium and a final high temperature anneal.

Several heats of nominal 6% chromium steels in accordance with the invention were prepared and subjected to cyclic oxidation tests and sag resistance tests. For comparison purposes, oxidation resistances of a nominal 2% chromium alloy and a nominal 12% chromium alloy were also determined at the same time. Compositions of the 4% to 7% chromium steels are set forth in Table XV, and cyclic oxidation tests are summarized in Table XVI. Sag resistance tests are not tabulated; however, by way of summary, after 96 hours exposure at 815° C. the nominal 6% chromium samples exhibited sag deflections ranging from about 25 to about 45 mils.

It is apparent from the data of Table XVI that the nominal 6% chromium alloy of this invention has oxidation resistance intermediate between that of the nominal 2chromium alloy and the nominal 12% chromium alloy, and that alloys with chromium in the range of 4% to 7% survive cyclic oxidation up through 815° C.

The description of the processing of the above heats indicates that the method of producing ferritic, cold reduced steel strip and sheet stock in accordance with the present invention comprises providing a cold reduced ferritic steel strip and sheet stock consisting essentially of, by weight percent, from about 0.01% to 0.05% carbon, about 1% maximum manganese, about 2% maximum silicon, about 1% to about 20% chromium, about 0.5% maximum nickel, about 0.5% to about 2% aluminum, about 0.01% to 0.05% nitrogen, 1.0% maximum titanium, with a minimum titanium content of 4 times the percent carbon plus 3.5 times the percent nitrogen, about 0.1% to 1.0% columbium, with the sum total of titanium plus columbium not exceeding about 1.2%, and remainder essentially iron, and subjecting the stock to a final anneal at a temperature of 1010° to 1120° C.

It will be evident from the data of Table VI and FIGS. 1-3 that the present invention provides cold reduced, ferritic steel strip and sheet stock annealed at 1010° to 1120° C., having a sag deflection after 140 hours at 870° C. not exceeding 300 mils by the herein described sag test, good oxidation resistance at temperatures ranging from about 732° to about 1093° C., and good weldability, the steel consisting essentially of, by weight percent, from about 0.01% to 0.06% carbon, about 1% maximum manganese, about 2% maximum silicon, about 1% to about 20% chromium, about 0.5% maximum nickel, about 0.5% to about 2% aluminum, about 0.01% to 0.05% nitrogen, 1.0% maximum titanium, with a minimum titanium content of 4 times the percent carbon plus 3.5 times the percent nitrogen, about 0.1% to 1.0% columbium, with the sum total of titanium plus columbium not exceeding about 1.2% and remainder essentially iron.

Cold reduced, ferritic steel strip and sheet stock annealed at 1010° to 1120° C., having a nominal 12% chromium content and a preferred composition of the present invention, will exhibit a sag deflection after 140 hours at 871° C. not exceeding 225 mils by the herein described sag test, as will be apparent from the data of Table VI and FIG. 1. Such a steel in the form of cold reduced strip and sheet stock annealed at 1010° to 1120° C., consists essentially of, by weight percent, from about 0.01% to about 0.03% carbon, about 0.5% maximum manganese, about 1% maximum silicon, about 11% to about 13% chromium, about 0.3% maximum nickel, about 0.75% to 1.8% aluminum, about 0.01% to about 0.03% nitrogen, about 0.5% maximum titanium, with a minimum titanium content of 4 times the percent carbon plus 3.5 times the percent nitrogen, about 0.2% to about 0.5% columbium, and remainder essentially iron. Preferably the sum total of titanium plus columbium is from 0.6% to 0.9%.

In view of the formability and weldability of the cold reduced steel of the present invention after a final anneal at 1010° to 1120° C., it is evident that the invention further includes fabricated articles and welded articles for high temperature service, with both the broad and preferred compositions of the steel. The chromium level can be selected within the broad range for specified service temperatures, thereby permitting production of a steel at the lowest possible cost of alloying ingredients consistent with the service temperature to which articles fabricated therefrom may be subjected. For example, an article for service at temperatures up to about 760° C. may contain from about 1% to about 3% chromium, with the remainder being in accordance with the broad composition of the steel of the invention. Articles which will undergo service at temperatures up to 815° C. should contain from about 4% to about 7% chromium, with the remainder in accordance with the broad composition of the steel of the invention. For articles which will undergo service at temperatures up to about 1093° C. the chromium range should be from about 18% to about 20%, with the remainder in accordance with the broad composition of the steel of the invention.

The elevated temperature sag tests reported herein were conducted as follows:

A test rack was utilized made from heavy gauge Type 310 austenitic stainless steel providing edges spaced 25.4 cm (10 inches) on which test specimens were supported. Longitudinal test specimens of 2.54×30.5 cm (1 inch×12 inch) were cut, deburred and cleaned. A brake formed 90° bend was put in each specimen approximately 1.25 cm from one end. This bend acted to retain one end of the specimen, so that as creep occurred over the 25.4 cm of unsupported specimen, additional material could be drawn from the excess of about 3.8 cm at the free end. The bend also acted as a marker to assure that deflection measurements were always taken at the same position on the specimen. Powdered clay was placed on the rack at the free end of each specimen to prevent sticking thereof during testing.

The relative creep or sag resistance of two or more materials could be measured in the above test apparatus by cutting and forming test coupons of the same gauge, measuring initial deflections on a dial gauge set between two supports 25.4 cm apart, testing, and then remeasuring the deflection. If the thickness of the test material is constant, the results are comparative since the equation for calculating the maximum stress in the outermost fibers of the specimen is reduced to (assuming the unsupported distance remained a constant 25.4 cm):

| | |
|---|---|
| Stress | $= 75\ \rho/t$ |
| where | $\rho$ = density |
| | $t$ = thickness |

It was determined that reproducibility of this sag test was excellent if temperature variations within the test furnace were minimized. In order to minimize temperature variations, all tests were conducted in a furnace equipped with an overhead fan. In addition, the rack was placed in the furnace sideways in order to minimize temperature variations between the front and back of the furnace.

Standards such as Types 304, 409 or 319 were also run with each sag trial in order to insure uniformity and reproducibility of test results.

Sag or deflection test comparisons have been found to correspond very closely with creep strengths.

TABLE I

| Heat | %C | %Mn | %S | %Si | %Cr | %Ni | %N | %Al | %Cb | %Ti | %Mo | Cb sol. | Ti sol. |
|---|---|---|---|---|---|---|---|---|---|---|---|---|---|
| | Composition - Weight Percent | | | | | | | | | | | | |
| A | .021 | .27 | .014 | .50 | 18.54 | .20 | .023 | — | .68 | .33 | .05 | .68 | .17 |
| B | .018 | .28 | " | .48 | 19.03 | .18 | " | — | .71 | .18 | 1.58 | .71 | .03 |

TABLE II

871° Sag Resistance

| Heat | Annealing Temp. °C. | Sag Deflection (mils) 1 Hr. | 3 Hr. | 8 Hr. | 24 Hr. | 96 Hr. |
|---|---|---|---|---|---|---|
| A | 871 | 241 | 302 | 352 | 385 | 447 |
| | 1038 | 22 | 39 | 63 | 95 | 132 |
| | 871/1038 | 17 | 36 | 52 | 75 | 117 |
| B | 871 | 186 | 274 | 341 | 388 | 411 |
| | 1038 | 21 | 36 | 52 | 71 | 114 |
| | 871/1038 | 9 | 28 | 44 | 77 | 129 |

TABLE III

899° C. Sag Resistance

| Heat | Annealing Temp. °C. | Sag Deflection (mils) 2 Hr. | 4 Hr. | 8 Hr. | 26 Hr. | 50 Hr. | 78 Hr. |
|---|---|---|---|---|---|---|---|
| A | 871 | 221 | 248 | 299 | 331 | 365 | 399 |
| | 871/1038 | 49 | 73 | 100 | 134 | 182 | 221 |
| B | 871 | 249 | 285 | 319 | 353 | 386 | 424 |
| | 871/1038 | 49 | 69 | 87 | 117 | 142 | 190 |

TABLE IV

| Heat | %C | %Mn | %S | %Si | %Cr | %Ni | %N | %Al | %Ti | %Cb | Cb Sol. | Ti Sol. |
|---|---|---|---|---|---|---|---|---|---|---|---|---|
| | Composition - Weight Percent | | | | | | | | | | | |
| C | .029 | .18 | .013 | .54 | 11.95 | .24 | .027 | 1.7 | — | .25 | —.15 | — |
| D | .029 | " | " | .55 | 11.88 | .23 | .028 | " | — | .49 | .08 | — |
| E | .026 | " | " | " | 11.89 | " | .029 | " | — | .71 | .32 | — |
| F* | .028 | .19 | " | .61 | 11.92 | .24 | .023 | " | .44 | .27 | .27 | .25 |
| G* | .029 | .17 | " | .60 | 11.88 | " | .022 | " | .47 | .49 | .49 | .28 |

*Steels according to the present invention

TABLE V

Annealed Mechanical Properties

| Heat | %Cb | %Ti | .2%Y.S. ksi | (MPa) | U.T.S. ksi | (MPa) | % Elong. (50.8mm) | Hard $R_B$ | Olsen Cup Ht.-in. | (mm) |
|---|---|---|---|---|---|---|---|---|---|---|
| C | .25 (0) | — | 44.0 | (303) | 63.9 | (440) | 29.5 | 81.0 | .318 | (8.0) |
| D | .49 (.08) | — | 44.0 | (303) | 65.0 | (448) | 31.5 | 80.5 | .340 | (8.7) |
| E | .71 (.32) | — | 46.3 | (320) | 68.6 | (473) | 33.0 | 82.0 | .355 | (9.0) |
| F* | .27 (.27) | .44 (.25) | 47.2 | (326) | 69.7 | (480) | 29.0 | 82.0 | .345 | (8.8) |
| G* | .49 (.49) | .47 (.28) | 49.2 | (339) | 73.3 | (506) | 28.0 | 84.0 | .360 | (9.1) |

( )Soluble level of element
*Steels according to the present invention

TABLE VI

871° Sag Resistance
Anneal Temperature 1065° C.

| Heat | Sag Deflection (mils) 1 Hr. | 4 Hr. | 24 Hr. | 48 Hr. | 140 Hr. |
|---|---|---|---|---|---|
| C | — | 120 | 520 | — | — |
| D | 40 | 60 | 95 | 120 | 380 |
| E | 25 | 35 | 80 | 110 | 325 |
| F* | 45 | 60 | 90 | 120 | 205 |
| G* | 50 | 55 | 75 | 90 | 180 |

*Steels according to the present invention

TABLE VII

Autogenous G.T.A. Welded Properties

| Heat | %Cb | %Ti | Olsen Cup Ht.-in. | (mm) | Min. 180° Bend Radius |
|---|---|---|---|---|---|
| C | .25 | — | .070 | (1.8) | 0T |
| D | .49 | — | cracked during welding | | |
| E | .71 | — | cracked during welding | | |
| F* | .27 | .44 | .165 | (4.2) | OT |
| G* | .49 | .47 | .080 | (2.0) | >4T |

*Steels according to the present invention
OT = outside thickness

TABLE VIII

| Heat | %C | %Mn | %S | %Si | %Cr | %Ni | %Al | %Cb | %Ti | %N | Cb+Ti |
|---|---|---|---|---|---|---|---|---|---|---|---|
| I* | .021 | .25 | .015 | .56 | 11.67 | .18 | .77 | .43 | .40 | .019 | .83 |
| J* | .013 | .20 | .015 | .46 | 11.39 | .20 | 1.24 | .19 | .22 | .023 | .41 |
| K* | .021 | .22 | .013 | .50 | 11.56 | .27 | 1.31 | .30 | .20 | .023 | .50 |
| L* | .022 | .22 | .013 | .51 | 11.59 | .26 | 1.27 | .44 | .20 | .022 | .64 |
| M* | .016 | .22 | .014 | .46 | 11.48 | .20 | 1.18 | .40 | .36 | .022 | .76 |
| N* | .019 | .20 | .012 | .42 | 11.39 | .19 | 1.27 | .18 | .46 | .022 | .64 |
| 0* | .019 | .26 | .012 | .59 | 11.61 | .21 | 1.37 | .30 | .45 | .020 | .75 |

TABLE VIII-continued

| Heat | %C | %Mn | %S | %Si | %Cr | %Ni | %Al | %Cb | %Ti | %N | Cb+Ti |
|---|---|---|---|---|---|---|---|---|---|---|---|
| P* | .026 | .25 | .013 | .60 | 11.58 | .20 | 1.33 | .42 | .45 | .019 | .87 |

*Steels according to the present invention

TABLE IX

| | | | Annealed Base Metal Properties | | | | | | | |
|---|---|---|---|---|---|---|---|---|---|---|
| | | | .2% Y.S. | | U.T.S. | | % Elong. | Hard | Olsen Cup | |
| Heat | %Ti | %Cb | ksi | (MPa) | ksi | (MPa) | 2" (50.8 mm) | $R_B$ | Ht.-in. | (mm) |
| I* | .40 | .43 | 41.0 | (283) | 65.0 | (448) | 31.0 | 78.0 | .390 | (9.9) |
| J* | .22 | .19 | 40.0 | (276) | 63.4 | (437) | 34.0 | 76.5 | .405 | (10.3) |
| K* | .20 | .30 | 43.4 | (293) | 66.1 | (456) | 36.0 | 78.0 | .395 | (10.0) |
| L* | .20 | .44 | 42.4 | (293) | 66.0 | (455) | 33.0 | 79.0 | .400 | (10.1) |
| M* | .36 | .40 | 41.2 | (284) | 64.5 | (444) | 33.5 | 77.5 | .400 | (10.1) |
| N* | .46 | .18 | 39.4 | (272) | 61.6 | (424) | 33.0 | 77.0 | .400 | (10.1) |
| O* | .45 | .30 | 43.3 | (298) | 65.5 | (452) | 33.0 | 80.0 | .410 | (10.4) |
| P* | .45 | .42 | 44.3 | (306) | 66.8 | (460) | 32.0 | 78.0 | .405 | (10.3) |

*Steels according to the present invention

TABLE X

| | | | Autogenous G.T.A. Weld Properties | | | | | | | | |
|---|---|---|---|---|---|---|---|---|---|---|---|
| | | | .2% Y.S. | | U.T.S. | | % Elong. | Failure | Minimum | Olsen Cup | |
| Heat | %Ti | %Cb | ksi | (MPa) | ksi | (MPa) | 2" (50.8mm) | Location | 180° Bend | Ht.-in. | (mm) |
| I* | .40 | .43 | 40.9 | (282) | 64.6 | (445) | 29.5 | B.M. | 180° Flat | .305 | (7.7) |
| J* | .22 | .19 | 40.2 | (277) | 64.2 | (443) | 30.0 | ↓ | ↓ | .355 | (9.0) |
| K* | .20 | .30 | 42.2 | (291) | 66.2 | (457) | 27.0 | ↓ | ↓ | .250 | (6.4) |
| L* | .20 | .44 | 42.6 | (294) | 66.4 | (458) | 28.0 | ↓ | ↓ | .360 | (9.2) |
| M* | .36 | .40 | 41.7 | (288) | 65.2 | (450) | 29.0 | ↓ | ↓ | .315 | (8.0) |
| N* | .46 | .18 | 39.4 | (272) | 61.8 | (426) | 30.5 | ↓ | ↓ | .280 | (7.1) |
| 0* | .45 | .30 | 43.4 | (300) | 66.0 | (455) | 28.0 | ↓ | ↓ | .215 | (5.5) |
| P* | .45 | .42 | 44.2 | (305) | 67.1 | (462) | 26.0 | ↓ | ↓ | .215 | (5.5) |

*Steels according to the present invention

TABLE XI

| | | Weight Gain (mg/in$^2$) | | | |
|---|---|---|---|---|---|
| Heat | %Al | 96 Cycles | 153 Cycles | 283 Cycles | 469 Cycles |
| I* | .77 | 6.1 | 7.8 | 11.5 | 18.4 |
| J* | 1.24 | 4.4 | 5.0 | 6.5 | 9.9 |
| K* | 1.31 | 4.2 | 6.0 | 10.0 | 15.1 |
| L* | 1.27 | 6.3 | 8.2 | 13.1 | 19.1 |
| M* | 1.18 | 2.6 | 2.9 | 4.2 | 6.9 |
| N* | 1.27 | 3.6 | 5.5 | 10.2 | 15.8 |
| 0* | 1.37 | 2.2 | 2.8 | 4.8 | 7.6 |
| P* | 1.33 | 3.3 | 3.8 | 5.0 | 9.1 |
| 490 | 0 | 266 | — | — | — |

Cycle:
25 min. heat
5 min. cool
*Steels according to the present invention

TABLE XII

| | Composition - Weight % | | | | | | | | | |
|---|---|---|---|---|---|---|---|---|---|---|
| Heat | % C | % Mn | % S | % Si | % Cr | % Ni | % N | % Al | % Ti | % Cb |
| Q | .036 | .27 | .014 | .68 | 17.68 | .29 | .028 | 1.7 | .48 | .06 |
| R | .037 | .29 | " | .76 | 19.09 | .27 | .029 | " | " | .80 |
| S* | .034 | .21 | .012 | .57 | 1.69 | .20 | .012 | 1.89 | .39 | .35 |

*Steels according to the present invention

TABLE XIII

| | | 899° C. Sag Resistance | | | | | |
|---|---|---|---|---|---|---|---|
| | Anneal | Sag Deflection (mils) | | | | | |
| Heat | Temp. °C. | 2 Hr. | 4 Hr. | 8 Hr. | 26 Hr. | 50 Hr. | 78 Hr. |
| Q | 927 | 296 | 454 | 519 | 551 | 577 | 625 |
| | 1093 | 83 | 114 | 182 | 342 | 380 | 455 |
| R | 1093 | 39 | 56 | 77 | 132 | 185 | 234 |

TABLE XIV

| | 815° C. Sag Resistance | | | | | |
|---|---|---|---|---|---|---|
| | Anneal | Sag Deflection (mils) | | | | |
| Heat | Temp°C. | 2 Hr. | 4 Hr. | 9 Hr. | 25 Hr. | 112.5 Hr. |
| S* | 1038 | 34 | 35 | 39 | 42 | 67 |
| 12 Cr—Cb—Ti | 1065 | 37 | 41 | 41 | 48 | 65 |

*Steel according to the present invention

TABLE XV

| | Composition - Weight Percent | | | | | | | | | |
|---|---|---|---|---|---|---|---|---|---|---|
| Heat | % C | % Mn | % S | % Si | % Cr | % Ni | % Al | % N | % Ti | % Cb |
| T* | .009 | .32 | .014 | .43 | 6.69 | .22 | 1.41 | .016 | .39 | .39 |
| U* | .011 | .38 | .014 | .38 | 5.85 | .30 | 1.94 | .014 | .40 | .41 |
| V* | .006 | .41 | .014 | 1.03 | 5.93 | .20 | 1.50 | .025 | .37 | .40 |

*Steels according to the present invention

TABLE XVI

| | | | | Weight Gain (Mg/in$^2$) | | | | |
|---|---|---|---|---|---|---|---|---|
| Heat | %Cr | %Al | %Si | 11 Cycles | 41 Cycles | 182 Cycles | 229 Cycles | 369 Cycles |
| T* | 6.69 | 1.41 | .43 | 18.1 | 19.7 | 20.4 | 20.6 | 20.8 |
| U* | 5.85 | 1.94 | .38 | 24.6 | 30.4 | 47.3 | 50.9 | 59.3 |
| V* | 5.93 | 1.50 | 1.03 | 7.1 | 7.3 | 7.4 | 7.6 | 7.7 |
| 2SR | 1.8 | 1.8 | .6 | 148.5 | (discontinued) | — | — | — |

TABLE XVI-continued

| Heat | %Cr | %Al | %Si | Weight Gain (Mg/in²) 11 Cycles | 41 Cycles | 182 Cycles | 229 Cycles | 369 Cycles |
|---|---|---|---|---|---|---|---|---|
| 12SR | 12.0 | 1.4 | .5 | .5 | .6 | .9 | 1.0 | 1.2 |

Cycle:
25 min. heat
5 min. cool
*Steels according to the present invention

We claim:

1. A ferritic steel having improved oxidation resistance and creep resistance at temperatures ranging from about 732° to 1093° C. (1350° to 2000° F.) after a final anneal at 1010° to 1120° C. (1850° to 2050° F.), together with good weldability, said steel consisting essentially of, by weight percent, from about 0.01% to 0.06% carbon, about 1% maximum manganese, about 2% maximum silicon, about 1% to about 20% chromium, about 0.5% maximum nickel, about 0.5% to about 2% aluminum, about 0.01% to 0.05% nitrogen, 1.0% maximum titanium, with a minimum titanium content of 4 times the percent carbon plus 3.5 times the percent nitrogen, about 0.1% to 1.0% columbium, with the sum total of titanium plus columbium not exceeding about 1.2%, and remainder essentially iron.

2. The ferritic steel claimed in claim 1, consisting essentially of from about 0.01% to about 0.03% carbon, about 0.5% maximum manganese, about 1% maximum silicon, about 1% to about 19% chromium, about 0.3% maximum nickel, about 0.75% to 1.8% aluminum, about 0.01% to about 0.03% nitrogen, about 0.5% maximum titanium, about 0.2% to about 0.5% columbium, and remainder essentially iron.

3. The steel claimed in claim 1 or 2, wherein chromium is from about 1% to about 3%.

4. The steel claimed in claim 1 or 2, wherein chromium is from about 11% to about 13%.

5. The steel claimed in claim 1 or 2, wherein chromium is from about 18% to about 20%.

6. Cold reduced, ferritic steel strip and sheet stock annealed at 1010° to 1120° C., having a sag deflection after 140 hours at 871° C. not exceeding 300 mils by the above described sag test, good oxidation resistance at temperatures ranging from about 732° to about 1093° C., and good weldability, said steel consisting essentially of, by weight percent, from about 0.01 to 0.06% carbon, about 1% maximum manganese, about 2% maximum silicon, about 1% to about 20% chromium, about 0.5% maximum nickel, about 0.5% to about 2% aluminum, about 0.01% to 0.05% nitrogen, 1.0% maximum titanium, with a minimum titanium content of 4 times the percent carbon plus 3.5 times the percent nitrogen, about 0.1% to 1.0% columbium, with the sum total of titanium plus columbium not exceeding about 1.2%, and remainder essentially iron.

7. Cold reduced, ferritic steel strip and sheet stock as claimed in claim 6, having a sag deflection after 140 hours at 871° C. not exceeding 225 mils by the above described sag test, said steel consisting essentially of, by weight percent, from about 0.01% to about 0.03% carbon, about 0.5% maximum manganese, about 1% maximum silicon, about 11% to about 13% chromium, about 0.3% maximum nickel, about 0.75% to about 1.8% aluminum, about 0.01% to about 0.03% nitrogen, about 0.5% maximum titanium, about 0.2% to about 0.5% columbium, and remainder essentially iron.

8. Article for high temperature service fabricated from a ferritic steel which has been subjected to a final anneal at 1010° to 1120° C. (1850° to 2050° F.), said steel consisting essentially of, by weight percent, from about 0.01% to 0.06% carbon, about 1% maximum manganese, about 2% maximum silicon, about 1% to about 20% chromium, about 0.5% maximum nickel, about 0.5% to 2% aluminum, about 0.01% to 0.05% nitrogen, 1.0% maximum titanium, with a minimum titanium content of 4 times the percent carbon plus 3.5 times the percent nitrogen, about 0.1% to 1.0% columbium, with the sum total of titanium plus columbium not exceeding about 1.2%, and remainder essentially iron.

9. Welded article for high temperature service fabricated from a ferritic steel which has been subjected to a final anneal at 1010° to 1120° C. (1850° to 2050° F.), said steel consisting essentially of, by weight percent, from about 0.01% to about 0.03% carbon, about 0.5% maximum manganese, about 1% maximum silicon, about 1% to about 19% chromium, about 0.3% maximum nickel, about 0.75% to 1.8% aluminum, about 0.01% to about 0.03% nitrogen, about 0.5% maximum titanium, about 0.2% to about 0.5% columbium, and remainder essentially iron.

10. Article for service at temperatures of about 732° to about 760° C. (1400° F.) fabricated from a ferritic steel which has been subjected to a final anneal at 1010° to 1120° C. (1850° to 2050° F.), said steel consisting essentially of, by weight percent, from about 0.01% to 0.06% carbon, about 1% maximum manganese, about 2% maximum silicon, about 1% to about 3% chromium, about 0.5% maximum nickel, about 0.5% to 2% aluminum, about 0.01% to 0.05% nitrogen, 1.0% maximum titanium, with a minimum titanium content of 4 times the percent carbon plus 3.5 times the percent nitrogen, about 0.1% to 1.0% columbium, with the sum total of titanium plus columbium not exceeding about 1.2%, and remainder essentially iron.

11. Article for service at temperatures of about 760° to about 815° C. (1500° F.) fabricated from a ferritic steel which has been subjected to a final anneal at 1010° to 1120° C. (1850° to 2050° F.), said steel consisting essentially of, by weight percent, from about 0.01% to 0.06% carbon, about 1% maximum manganese, about 2% maximum silicon, about 4% to about 7% chromium, about 0.5% maximum nickel, about 0.5% to 2% aluminum, about 0.01% to 0.05% nitrogen, 1.0% maximum titanium, with a minimum titanium content of 4 times the percent carbon plus 3.5 times the percent nitrogen, about 0.1 to 1.0% columbium, with the sum total of titanium plus columbium not exceeding about 1.2%, and remainder essentially iron.

12. Article for service at temperatures of about 955° to about 1093° C. (2000° F.) fabricated from a ferritic steel which has been subjected to a final anneal at 1010° to 1120° C. (1850° to 2050° F.), said steel consisting essentially of, by weight percent, from about 0.01% to 0.06% carbon, about 1% maximum manganese, about 2% maximum silicon, about 18% to about 20% chromium, about 0.5% maximum nickel, about 0.5% to 2% aluminum, about 0.01% to 0.05% nitrogen, 1.0% maximum titanium, with a minimum titanium content of 4 times the percent carbon plus 3.5 times the percent nitrogen, about 0.1% to 1.0% columbium, with the sum total of titanium plus columbium not exceeding about 1.2%, and remainder essentially iron.

13. A method of producing ferritic, cold reduced steel strip and sheet stock having improved oxidation resistance and creep resistance at temperatures ranging from about 732° to about 1093° C. (1350° to 2000° F.), together with good weldability and toughness, which comprises providing a cold reduced ferritic steel strip and sheet stock consisting essentially of, by weight percent, from about 0.01% to 0.06% carbon, about 1% maximum manganese, about 2% maximum silicon, about 1% to about 20% chromium, about 0.5% maximum nickel, about 0.5% to 2% aluminum, about 0.01% to 0.05% nitrogen, 1.0% maximum titanium, with a minimum titanium content of 4 times the percent carbon plus 3.5 times the percent nitrogen, about 0.1% to 1.0% columbium, with the sum total of titanium plus columbium not exceeding about 1.2%, and remainder essentially iron, and subjecting said stock to a final anneal at a temperature of 1010° to 1120° C. (1850° to 2050° F.).

* * * * *